United States Patent [19]

Cleff

[11] 3,989,286

[45] Nov. 2, 1976

[54] DEVICE FOR ARRESTING A DOOR

[75] Inventor: Herbert Cleff, Ennepetal, Germany

[73] Assignee: Dorma-Baubeschlag GmbH & Co. KG, Ennepetal-Voerde, Germany

[22] Filed: Oct. 9, 1974

[21] Appl. No.: 513,442

[30] Foreign Application Priority Data

Oct. 11, 1973 Germany ..... 2351042
Sept. 11, 1974 Germany ..... 2443444

[52] U.S. Cl. ..... 292/181; 292/144; 292/153; 292/201; 292/DIG. 4; 292/DIG. 15; 292/DIG. 65

[51] Int. Cl.[2] ..... E05C 1/08; E05C 3/22; E05C 5/00; E05C 17/44

[58] Field of Search ..... 292/144, 181, 201, 153, 292/DIG. 15

[56] References Cited

UNITED STATES PATENTS

| | | | |
|---|---|---|---|
| 643,850 | 2/1900 | Rogers | 292/181 |
| 684,586 | 10/1901 | Neher et al. | 292/181 |
| 739,906 | 9/1903 | Neher et al. | 292/DIG. 15 |
| 938,114 | 10/1909 | Boettcher | 292/DIG. 15 |
| 942,893 | 12/1909 | Ellerbe | 292/181 |
| 1,300,319 | 4/1919 | Winter | 292/144 |
| 1,772,604 | 8/1930 | Herz | 292/144 |
| 2,435,729 | 2/1948 | Whann et al. | 292/201 X |
| 3,791,687 | 2/1974 | Schroeder | 292/DIG. 15 |

FOREIGN PATENTS OR APPLICATIONS

| | | | |
|---|---|---|---|
| 19,259 | 10/1904 | United Kingdom | 292/DIG. 15 |

*Primary Examiner*—Paul R. Gilliam
*Assistant Examiner*—C. F. Pietruszka
*Attorney, Agent, or Firm*—Michael J. Striker

[57] ABSTRACT

An arresting arrangement is mountable on the lower edge of a door adjacent to the floor and is movable between an inoperative and an operative position. A biasing spring permanently biases the arrangement to the inoperative position, and a latching arrangement serves to releasably latch the arresting arrangement in the operative position. An electromagnet controls the operation of the latching arresting arrangement.

17 Claims, 6 Drawing Figures

DEVICE FOR ARRESTING A DOOR

BACKGROUND OF THE INVENTION

The present invention relates to a device for arresting a door, particularly for arresting a door in an open position.

It is known to provide door arresting devices which are mounted at the lower edge region of a door, adjacent the floor, and which serve to hold the door open at any selected opening angle. This is particularly true for doors which are permanently biased towards their closed position, for example by biasing springs, door closers or the like.

Door arresting devices known from the prior art as a general rule have a member that can be moved into and out of engagement with the floor and which can be embraced by a pivotable or tiltable member that serves to lock the arresting member in place when the device is in use. For various reasons the prior-art devices of this type are not entirely satisfactory, which is also true of prior-art devices which use electromagnets to hold the door open. The latter type of arrangement of course requires a substantial amount of energy and, moreover, these devices are quite bulky.

SUMMARY OF THE INVENTION

It is a general object of the present invention to provide a door arresting device which avoids the disadvantages of the prior art.

More particularly, it is an object of the present invention to provide a device for arresting a door which is electromagnetically controlled and which can be used with any desired type of door and is capable of maintaining such a door in any selected open position.

Another object of the invention is to provide such a device which is relatively simple in its construction and quite small so as not to require any significant amount of space for its installation.

In keeping with these objects, and with others which will become apparent hereafter, one feature of the invention resides in a device for arresting a door, particularly in an open position, which comprises arresting means mountable on the lower edge of a door adjacent to the floor, for movement between an inoperative and an operative position. Biasing means permanently biases the arresting means to the inoperative position. Latching means releasably latches the arresting means in the operative position thereof, and electromagnetic means serves to control the latching means.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 4:
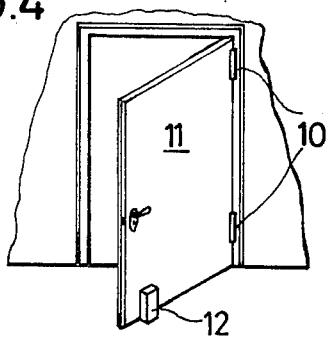
FIG. 4 is a diagrammatic perspective, showing for purposes of orientation where a device according to the present invention will be installed on a door.

Referring firstly to FIG. 4 of the drawing, it will be seen that reference numeral 11 identifies a door which is mounted in the usual manner in a frame, by means of hinges 10. One of these may be a spring hinge, or there may be a door closer provided, but in any case the purpose would be to permanently urge the door 11 to closed position. To be able to hold the door 11 in any selected fully or partly open position, an arresting device 12 according to the present invention is provided, which is mounted in the region of the lower edge of the door 11 and which cooperates with the floor to arrest the door 11 in the fully or partly open position.

The arresting device 12 may be of the type illustrated in FIGS. 1–3, or it may be in form of a different embodiment, as will be explained later.

Figure 1:
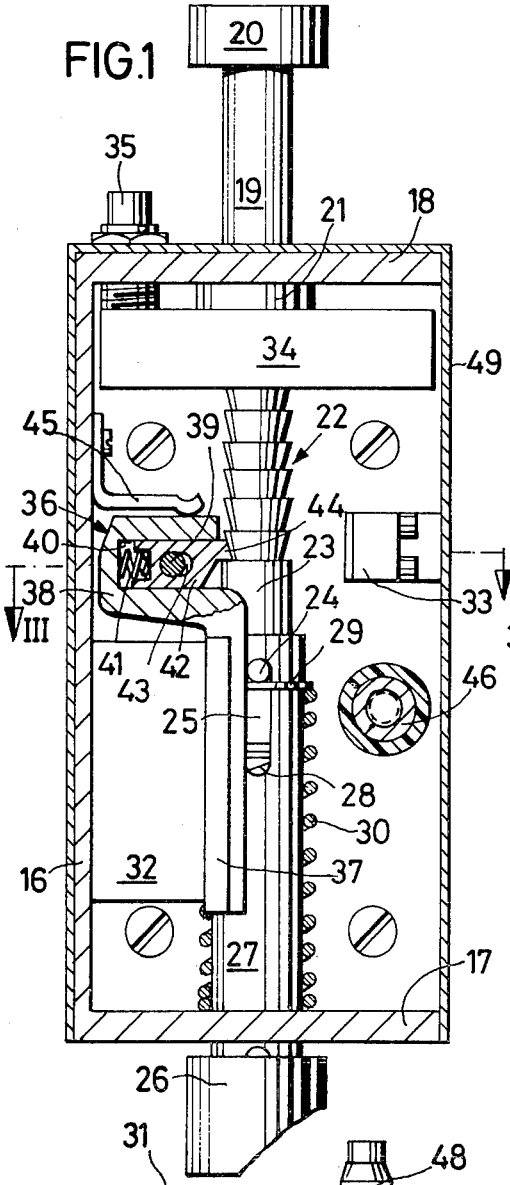
FIG. 1 is a vertical section through an embodiment of the invention, showing the device in its inoperative position.
Figure 2:
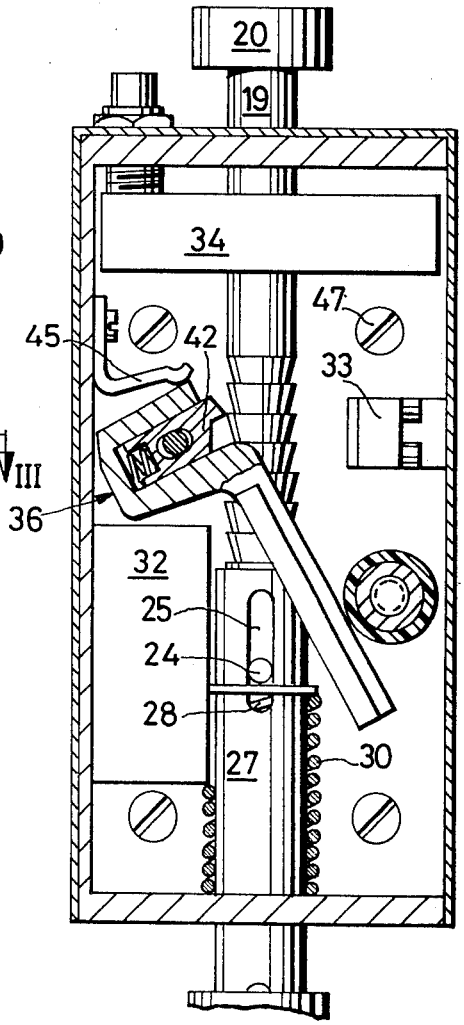
FIG. 2 is a view similar to FIG. 1, but showing the device in operative position.
Figure 3:
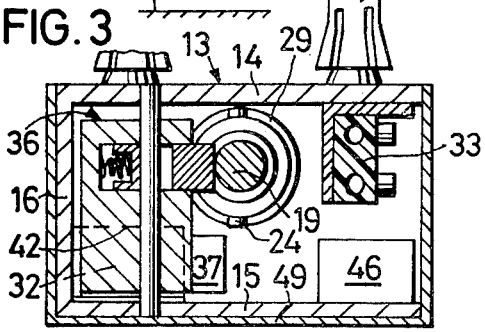
FIG. 3 is a section taken on line III—III of FIG. 1.

FIGS. 1–3 show an embodiment of the device 12 wherein the device has a housing 13 which is open at one of its narrow vertical sides and which has a rear wall 14, a front wall 15 opposite the rear wall 14, a narrow side wall 16, a bottom wall 17 and an upper wall 18. The upper or top wall 18 is formed with a cutout in which a pin 19 is mounted so that it can be vertically shifted; the pin 19 has a head 20 which projects upwardly out of the housing 13 and is enlarged so that it can be conveniently stepped on by a user. The pin 19 further carries an abutment ring 21 which determines the starting position of the pin 19 and for this purpose engages the downwardly directed inner side of the upper wall 18; it is preferable if the abutment ring 21 is of elastic or yieldable material, for instance synthetic or natural rubber, or synthetic plastic material. Downwardly of the ring 21, the pin 19 is formed with detent portions in form of a row of teeth 22 which in this embodiment are of sawtooth-shaped configuration, and downwardly of the teeth 22, the pin 19 is formed with a cylindrical portion 23 through which a pin 24 extends in transverse direction, so that its opposite ends project outwardly beyond the portion 23. The outward ends of the pin 24 extend into transversely spaced registering vertical slots 25 formed in a sleeve 27 which is journalled in the wall 17 for vertical displacement and which can shift relative to the portion 23 which it surrounds, by a vertical distance determined by the length of the slots 25. The end portion of the sleeve 27 extends downwardly below the wall 17 and there it carries a yieldable engaging portion 26, for instance of rubber or synthetic plastic material, whose purpose is to engage the floor and thus to frictionally retain the door 11 on which the device 12 is mounted. The sleeve 27 is formed in its interior with an appropriate abutment upon which an end of a helical expansion spring 28 bears, the other end of which bears against the lower end face of the end portion 23 of the pin 19. A further helical expansion spring 30 surrounds the sleeve 27 exteriorly thereof and abuts with one end against a ring 29 which also surrounds the sleeve 27 and is prevented from upward movement by abutment with the outer end portions of the pin 24; the other end of the spring 30 abuts the wall 17. The pin 19 and the sleeve 27 with the associated parts together form an arresting device which can be shifted downwardly against the floor 31 that is diagrammatically shown in FIG. 1, so as to frictionally engage the floor as mentioned before. This downward shifting is accomplished by a user placing his foot upon the head 20 and pushing downwardly, thereby shifting the arrangement against the floor 31 and at the same time compressing the springs 28 and 30.

An electromagnet 32 is mounted in the housing 13 on the side wall 16 and has a pole surface which faces away from the side wall 16. The electromagnet 32 receives electrical energy via appropriate conductors (not illustrated, because they are known per se and entirely conventional) from terminals 33 via a switch 34 having an actuating portion 35. The switch 34 is of the type which, when the actuating portion 35 is released, permits the flow of electrical current and interrupts the flow while the actuating portion 35 is pushed in and for the duration of the pushed-in condition. The switch 34 may in other words be of the pushbutton type.

A latching member 36 is located between the electromagnet 32 and the pin 19 and has an arm 37 which is associated with the electromagnet 32 and in fact forms the armature thereof, and an arm 38. The member 36 is pivotable about a pivot pin 39 which is mounted in the walls 14 and 15. The arm 37 can abut the pole surface of the electromagnet 37; if desired, a non-magnetizable intermediate layer may be provided between the pole surface and the arm 37 so that no direct contact between them will take place. The arm 38 is formed with a bore 40 in which a retaining member 42 is displaceable by a distance determined by the length of a slot 43 through which the pin 39 extends; a prestressed spring 41 bears upon the retaining member 42, which latter has a nose 44 corresponding in shape to the profiling of the detent portions or teeth 22. A spring 45 is mounted on the housing wall 16 and is prestressed in the sense urging the member 36 to pivot so that its arm 37 abuts against the pole surface of the electromagnet 32. To delimit the pivoting movement of the member 36, an abutment 46 is provided on the wall 15 which is yieldable or else coated or otherwise surrounded by a yieldable material, for instance synthetic plastic or synthetic or natural rubber.

The housing 13 can be secured to the door 11 (see FIG. 4) by blind nuts 48 cooperating with screws 47 which are accessible through non-illustrated holes in the wall 15. After the housing is mounted on the door 11, a cap 49 can be placed over it which will also close its open side.

As previously mentioned, FIG. 1 shows the inoperative position of the device, in which the elements 19 and 27 assume the position which is determined by the biasing action of the spring 30 and the engagement of the abutment 21 with the underside of the wall 18. The member 36 engages with its arm 37 the pole surface of the electromagnet 32 under the urging of the spring 45. The retaining member 42 engages into a space between two of the detent portions or teeth 22 under the urging of the spring 41. The spring 28 is largely relaxed and the pin 24 engages the upper end of the slots 25. This starting position is assumed, independently of whether or not the electromagnet 32 is energized, so that the starting position of the components does not change when the electromagnet 32 is energized.

When it is desired to arrest the door 11 in an open position, the electromagnet 32 is energized and the door 11 is opened to the desired extent, whereupon the user pushes down on the head 20 and thereby displaces the elements 19 and 27 downwardly. The retaining member 42 yields to permit the downward movement of the teeth 22. The relative position of the pin 19 with reference to the sleeve 27 remains unchanged, so that only the spring 30 is stressed via the pin 24 and the ring 29, until the portion 26 is in engagement with the floor 31; further pressure upon the head 20 then causes the spring 28 to also become stressed as a result of movement of the end portion 23 deeper into the sleeve 27. The further displacement of the pin 19 also results in further stressing of the spring 30. Since the nose 44 has yielded during this movement with each engagement of the successive teeth 22, but has always snapped back into the space between the tooth to which it has just yielded and the next-following tooth as seen in upward direction, the device will be arrested in the latched position by the fact that the pin 19 cannot move upwardly once pressure upon the head 20 is removed, due to the presence of the nose 44 and its engagement in the space between two of the teeth 22. Thus, the arresting position is maintained as long as the electromagnet 32 remains energized and maintains the arm or armature 37 in abutment with its pole surface. When it is desired to permit the door 11 to close again, then either the actuating portion 35 of the switch 34 is depressed, or else a remote signal is issued, but in either case the electromagnet 32 will be deenergized so that the arm 37 of the member 36 is now free, so that the member 36 is pivoted in counterclockwise direction by the springs 28 and 30 via the retaining member 42, thus permitting the pin 19 and the sleeve 27 to move upwardly back to the starting position which they had assumed in FIG. 1. This upward movement is terminated when the abutment 21 engages the wall 18, whereupon the member 36 returns to its starting position under the urging of the spring 45, and the device is now ready for the next use.

Figure 5:
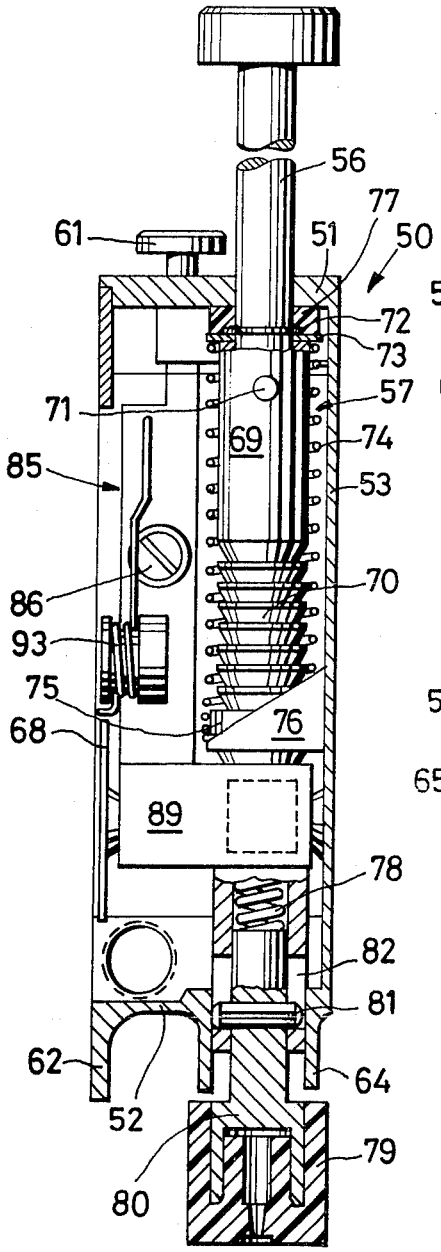
FIG. 5 is a view similar to FIG. 1 but illustrating a different embodiment of the invention.
Figure 6:
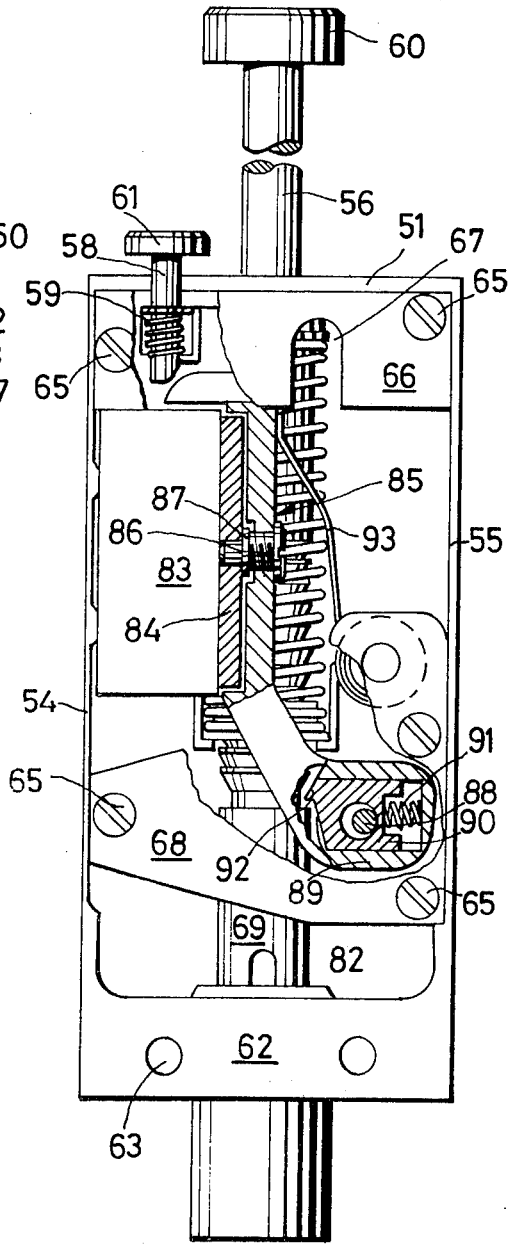
FIG. 6 is a partly sectioned, partly broken away side view of the embodiment in FIG. 5.

FIGS. 5 and 6 show a further embodiment of the invention, which is also to be mounted on the door 11 in the manner illustrated in FIG. 4. The embodiment in FIGS. 5 and 6 has a housing 50 which is open on one of its larger sides and is formed with an upper or top wall 51, a bottom wall 52, a front wall 53 and two side walls 54 and 55. The upper wall 51 is formed with a cutout for a shaft 56 of a member 57 and with a cutout for a shiftable wedge shaped releasing member 58 which is urged to its inoperative position by a spring 59. The shaft 56 carries a kick plate 60 corresponding to the head 20 of FIGS. 1–3, and a similar kick plate 61 is provided on the releasing member 58. The bottom wall 52 of the housing is formed with a flange 62 with openings 63 for mounting screws by means of which the device is to be mounted on the door 11. Furthermore, the wall 52 is formed with an opening for the member 57, which opening is bounded by a downwardly projecting annular collar 64 in which a guide sleeve (not shown) may be located. At the side which is to face the door 11, the upper region of the housing 50 is provided with a plate 66 that is removably held in place by screws 65 and formed with a cutout 67 so that the housing 50 can be pushed onto the head of a screw or the like that is previously mounted on the door. A further plate 68 may be mounted on the lower region of the housing by means of screws 65, and the purpose of the plate 68 will be discussed subsequently.

The center portion of the member 57 is in form of a tubular section 69 which is formed over a part of its length with detent portions in form of sawtooth-shaped teeth 70. A pin 71 connects the portion 69 with the shaft 56 which latter abuts via a spring ring 72 against an annular washer 73 serving as an abutment for a restoring spring 74, one end of which abuts the washer 73 whereas its other end abuts a centering sleeve 75 which is supported on a portion 76 that extends from the wall 53 of the housing. The restoring spring 74 urges the member 57 permanently to its starting position, which is defined by an elastic ring 77 that engages the underside of the upper wall 51 and cooperates as an abutment with the washer 73.

Mounted in the lower end portion of the tubular section 69 and supported by a prestressed helical spring 78, is a foot 80 which carries a cap or portion 79 of yieldable material, such as synthetic or plastic rubber or the like. The foot 80 is shiftable in the lower end portion of the tubular section 69 and is held in place by a split pin 81 that extends into diametrally opposite registering longitudinal slots 82 formed in the tubular section 69.

The foot 80 is shown in FIGS. 5 and 6 in its starting position and will be shifted downwardly by exerting pressure upon the kick plate 60, until it engages the floor (not shown in FIGS. 5 and 6).

Mounted on the side wall 54 in the upper region, that is remote from the bottom wall 52, there is provided an electromagnet 83 which has associated with it a plate-shaped armature 84 that is mounted by means of a screw 86 on an arm 85. A nose is provided on a free end of the arm 85 and projects towards the releasing member 58 so that the arm 85 can be restored to its starting position by operation of the releasing member 58 when necessary. An elastically deformable annular washer 87 is located between the arm 85 and the armature 84 and permits tilting movements of the armature 84. The arm 85 is mounted so that it can pivot about a pivot pin 88 one end of which is journalled in the wall 53 and the other end of which is journalled in the plate 68. The pivot pin 88 extends with play through a retaining member 90 that is slidably guided in the base portion 89 of the arm 85 and is urged towards the member 57 by a prestressed helical spring 91. The retaining member 90 is formed with a nose 92, and a spring 93 acts upon the arm 85 and permanently tends to bias the same for tilting movement to an arresting position.

To operate the device of FIGS. 5 and 6, the electromagnet 83 is energized while the door is still closed, thus maintaining the arm 85 in the position shown particularly clearly in FIG. 6, to which it is urged by the spring 93. After the door 11 has been opened, the member 57 can be pushed downwardly by pressure exerted upon the kick plate 60, until the foot 80 has been shifted downwardly against the force of the spring 78 into arresting engagement with the floor. The retaining member 90 with the nose 92 yields to the detent portions or teeth 70 that move past it during this operation, and finally engages one of the teeth in a sense preventing upward movement of the member 57 when further pressure upon the kick plate 60 is released. The door is now held in its open position. When the electromagnet becomes deenergized, the armature 84 is released so that the force retaining the arm 85 in the operative position of FIG. 6 is terminated. The force of the spring 74 now pivots the arm 85 in clockwise direction against the spring 93, so that the nose 92 is withdrawn from the associated tooth 70 and permits the member 57 to move upwardly so that the door can close. If the door is to be allowed to close while the electromagnet 83 is still energized, the releasing member 58 is depressed and this lifts the arm 85 off the electromagnet 83, so that the return of the device to its inoperative position proceeds as described before.

After each disengagement of the armature 84 from the electromagnet 83, the spring 93 returns the armature 84 back into engagement with the electromagnet 83, so that the device is always ready for the next operation.

It is clear that the device according to the present invention can be mounted very readily on the door, is not bulky and does not at all detract from the appearance of the door. Nevertheless, it is so reliable in its operation in that it fully releases the door when deenergized, and it will not interfere with the return movement of the door to closed position whenever this is desired.

When the device is constructed in accordance with FIGS. 5 and 6, its electromagnet can be connected into an electric circuit of the type which, for example, interrupts the supply of electric energy as a result of the detection of smoke, fire or the like. In this case, the door will immediately be released for automatic return (under the influence of its door closer or spring) to closed position.

It will be appreciated that the teeth in the various embodiments need not be of sawtooth-shaped profiles, although this is found to be advantageous in terms of a particularly reliable operation.

Mounting the pivotable components in the aforementioned manner, that is for pivotal movement, has the advantage that only a small amount of friction will develop to oppose such pivoting movement even if the device is not regularly serviced and supervised. However, other mountings than mounting for pivoting movement might also be utilized.

It is advantageous if the electromagnet and the pivot axis of the pivotable arm are located at one and the same side of the arresting means, and if the electromagnet is located at a level higher than the pivot axis, but it could also be located at opposite sides of the arresting means, with the electromagnet again being located at a level higher than the pivot axis, this latter arrangement providing for a better space utilization. The arrangement of the various components in the device according to the present invention makes it possible for the arm carrying the armature to be relatively large-dimensioned so that the retaining force of the electromagnet can act upon a rather long lever arm and the electromagnet need therefore not be particularly strong. This is advantageous in terms of the reliability of operation of the device, particularly if according to the embodiment in FIGS. 5 and 6, the armature plate is tiltably mounted on the arm so that the armature plate can adjust itself with reference to the electromagnet to an optimum position where the electromagnet can exert optimum force.

Modifications are, of course, possible and encompassed within the intent of the invention. For example, the members 42 or 90 could be constructed as pivotable pawls, rather than as slidable members. The relative arrangement of the components could be changed. Although the members 36 and 90–92 are pivotably mounted in the illustrated embodiments, they could also be shiftably mounted.

It will be understood that each of the elements described above, or two or more together, may also find a useful application in other types of constructions differing from the types described above.

While the invention has been illustrated and described as embodied in a device for arresting a door, it is not intended to be limited to the details shown, since various modifications and structural changes may be made without departing in any way from the spirit of the present invention.

Without further analysis, the foregoing will so fully reveal the gist of the present invention that others can be applying current knowledge readily adapt it for various applications without omitting features that, from the standpoint of prior art fairly constitute essential characteristics of the generic or specific aspects of this invention.

What is claimed as new and desired to be protected by Letters Patent is set forth in the appended claims.

I claim:

1. A device for arresting a door, particularly in an open position, comprising arresting means mounted at a lower portion of a door adjacent to a floor for movement between an inoperative position in which said arresting means is disengaged from, and an operative position in which said arresting means engages, the floor; biasing means for permanently biasing said arresting means toward said inoperative position thereof; latching means mounted at the lower portion of the door for displacement between a first position in which said latching means engages said arresting means to thereby prevent movement of the latter toward said inoperative position thereof, and a second position in which said latching means releases said arresting means for movement toward said inoperative position, and including a magnetically attractable portion; and electromagnetic means at the lower portion of the door and operative for magnetically attracting said magnetically attractable portion of said latching means to thereby hold said latching means in said first position thereof.

2. A device as defined in claim 1, wherein said electromagnetic means includes an electromagnet which releases said latching means for displacement toward said second position when deenergized.

3. A device as defined in claim 2, wherein said arresting means comprises detent portions; and wherein said latching means comprises a movable spring-biased retaining member which engages said detent portions in said first position.

4. A device as defined in claim 3, said arresting means having a housing; and further comprising a switch for said electromagnet in said housing and having an actuating portion which projects from the housing.

5. A device as defined in claim 1 wherein said arresting means includes a row of teeth; and said latching means comprises a latching member which cooperates with said teeth.

6. A device as defined in claim 5, and further comprising a spring biasing said first latching member to said first position.

7. A device as defined in claim 5, wherein said teeth are of sawtooth-shaped configuration.

8. A device as defined in claim 5, wherein said latching member is a lever pivotable about a pivot axis which extends transverse to the direction of movement of said arresting means.

9. A device as defined in claim 8; said latching member further comprising a spring-biased retaining member for engaging said teeth.

10. A device as defined in claim 9, wherein said retaining member is a slidable retaining member.

11. A device as defined in claim 8, wherein said electromagnetic means and said pivot axis are both offset laterally to one side of said arresting means, and said electromagnetic means is located at a lower level than said pivot axis.

12. A device as defined in claim 8, wherein said electromagnetic means and said pivot axis are offset laterally to opposite sides of said arresting means, and said electromagnetic means is located at a higher level than said pivot axis.

13. A device as defined in claim 1, said arresting means having a housing including a lower base portion facing said floor, and said arresting means further having an upper abutment portion; and wherein said biasing means comprises a pressure spring surrounding said arresting means and bearing against said base portion and said abutment portion.

14. A device as defined in claim 1; and further comprising a releasing member engageable with said latching means for releasing the same for movement to said second position.

15. A device as defined in claim 14, wherein said releasing member is a spring-biased slidable wedge member.

16. A device as defined in claim 1, said latching means comprising a lever movable between said first and second positions; and wherein said portion is an armature plate tiltably connected with said lever.

17. A device for arresting a door, particularly in an open position, comprising arresting means including a component formed with a plurality of teeth and mounted at the door adjacent a floor for movement between an inoperative position in which said arresting means is disengaged from, and an operative position in which said arresting means engages, the floor; first biasing means for permanently urging said component toward said inoperative position thereof; latching means including a latching member mounted at the door for displacement between an engaging and a disengaging position, a slide member mounted in said latching member for displacement between an extended and a retracted position, and second biasing means for urging said slide member toward said extended position thereof; third biasing means for urging said latching member toward said engaging position thereof so that said slide member engages one of said teeth of said component when in said extended position thereof; and electromagnetic means including at least one electromagnet operative for holding said latching member in said engaging position thereof when energized.

* * * * *